US005345707A

United States Patent [19]

Randall

[11] Patent Number: 5,345,707

[45] Date of Patent: Sep. 13, 1994

[54] INTERCHANGEABLE LASER CAVITY CARTRIDGE

[75] Inventor: David A. Randall, Alexandria, Va.

[73] Assignee: The United States of America as represented by the Secretary of the Army, Washington, D.C.

[21] Appl. No.: 40,961

[22] Filed: Mar. 31, 1993

[51] Int. Cl.[5] ..... F41G 1/35

[52] U.S. Cl. ..... 42/103; 362/110

[58] Field of Search ..... 42/103; 33/241; 362/110, 113, 114

[56] References Cited

U.S. PATENT DOCUMENTS 4,152,754 5/1979 de Filippis et al. ..... 362/113
4,939,863 7/1990 Alexander et al. ..... 42/103
4,969,153 11/1990 Leyshon et al. ..... 372/65
5,255,251 10/1993 Fitzgerald et al. ..... 369/36

FOREIGN PATENT DOCUMENTS 654655 2/1986 Switzerland ..... 362/110

*Primary Examiner*—Stephen M. Johnson
*Attorney, Agent, or Firm*—Alain L. Bashore; Milton W. Lee; Anthony T. Lane

[57] ABSTRACT

An interchangeable laser cavity cartridge includes side, front and back walls which include v-way elements to provide optical alignment and releasable spring loaded locks to lock into a cartridge receptacle coupled to a weapon. Spring loaded electrical connections allow electrical connection to a laser cavity housed within the cartridge to activated a laser system within.

2 Claims, 4 Drawing Sheets

INTERCHANGEABLE LASER CAVITY CARTRIDGE

BACKGROUND OF INVENTION

1. Field of the Invention

The present invention generally relates to cartridge devices and more specifically, to interchangeable laser cavity cartridges coupled substantially underneath a weapon.

2. Description of Related Prior Art

Laser countermeasures mounted on a single weapon are utilized on the modern battlefield with more and more importance in an overall battlefield strategy. The specific laser source to be utilized depends on the specific target threat under consideration. As a countermeasure against a daytime camera or low light level video there would be required use of a visible laser source, while as a countermeasure to a sensor or image intensifier device a visible or near infrared laser source would be required. When used as a training device, an eyesafe laser would be utilized, such as that currently used with the MILES system for the M-16 weapon. Modern battlefield tactics usually require the detection and identification of multiple threat targets, with tactics appropriate to various optical and electro-optical devices.

In the prior art, a laser to be mounted, as normally used on a single weapon, has been selected by identifying the most critical operational characteristic of the overall laser design. This approach has produced a system optimized for a single target, thus potentially exposing the system and user to unexpected threats. A single laser would be designed with only limited characteristics and not manportable due, to the size and weight associated with the design. A soldier would accordingly have the ability to engage only one type of enemy target. In order to engage other threat targets he would be required to carry differently designed systems, thus increasing weight and size that the soldier has to employ and limiting the possible engageable targets. The operator would also fail to have the capability for training with the actual system due to the inherent dangers associated with a laser of the magnitude necessary such as to counter an electro-optical systems.

While the prior art has reported using lasers on weapons, none have established a basis for a specific apparatus that is dedicated to the task of resolving the particular problem at hand.

What is needed in this instance is an interchangeable laser cavity cartridge which allows the use of different lasers to the same weapon, and to provide a method and apparatus for training the user.

SUMMARY OF THE INVENTION

It is therefore the primary object of this invention to provide an interchangeable laser cavity cartridge which allows the use of different laser systems so as to provide lasing at different frequencies in the frequency spectrum associated with a single weapon.

According to the invention, a laser cavity cartridge including V-way elements on its outer wall surfaces allow optical alignment in 3 dimensions. Spring loaded locks allow for the cartridge to be locked in place within a cartridge receptacle coupled to a weapon. Through spring loaded electrical connections, power is supplied to a flash lamp which activates a laser rod to emit laser light which is reflected out an optical aperture. The cartridges may be color coded for the specific laser used. The weapon coupled to the cartridge receptacle of the disclosed embodiment is a M-16 rifle.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT

Figure 1:
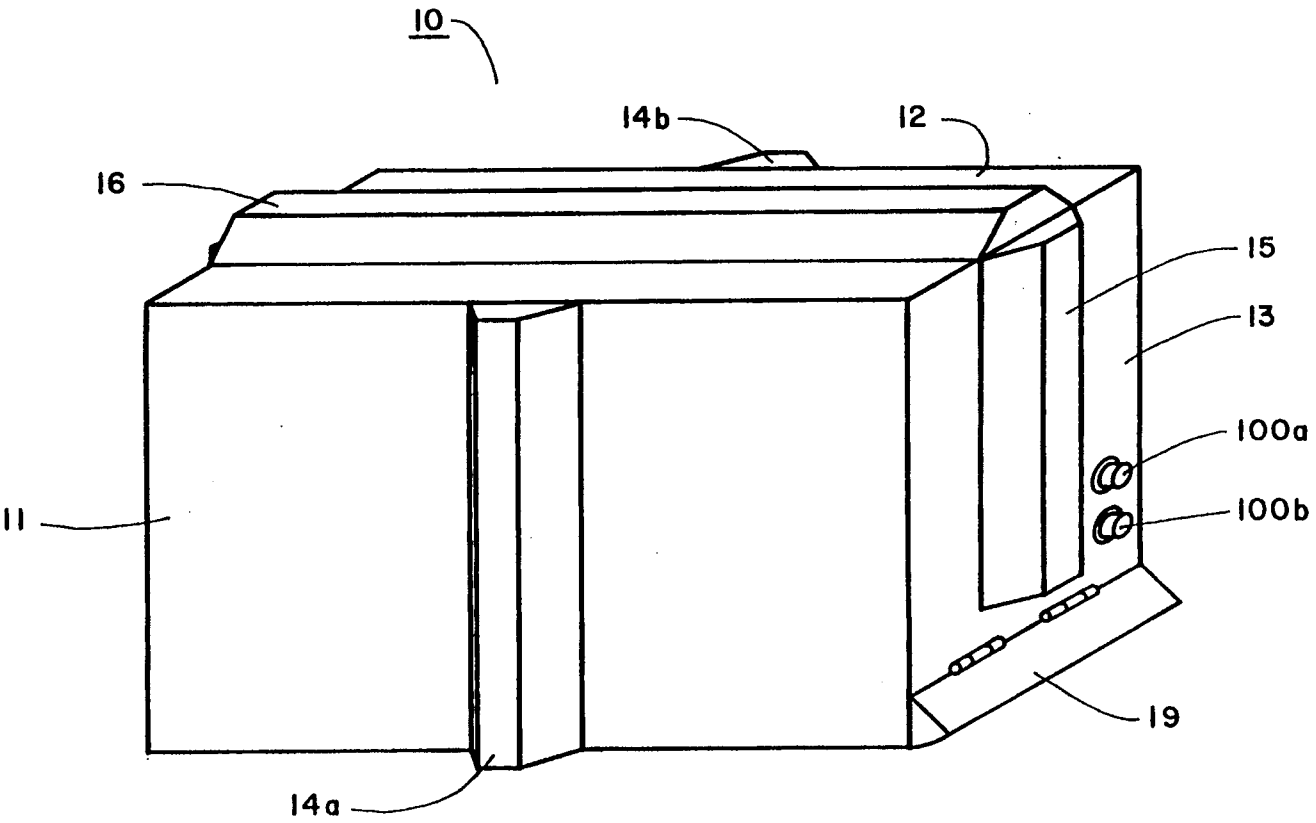
FIG. 1 is an isometric drawing of the laser cartridge.
Figure 2:
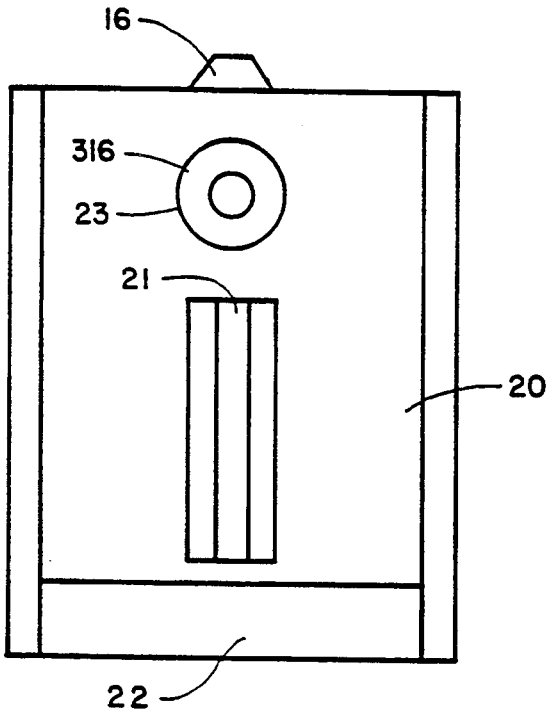
FIG. 2 is a front view drawing of FIG. 1.
Figure 3:
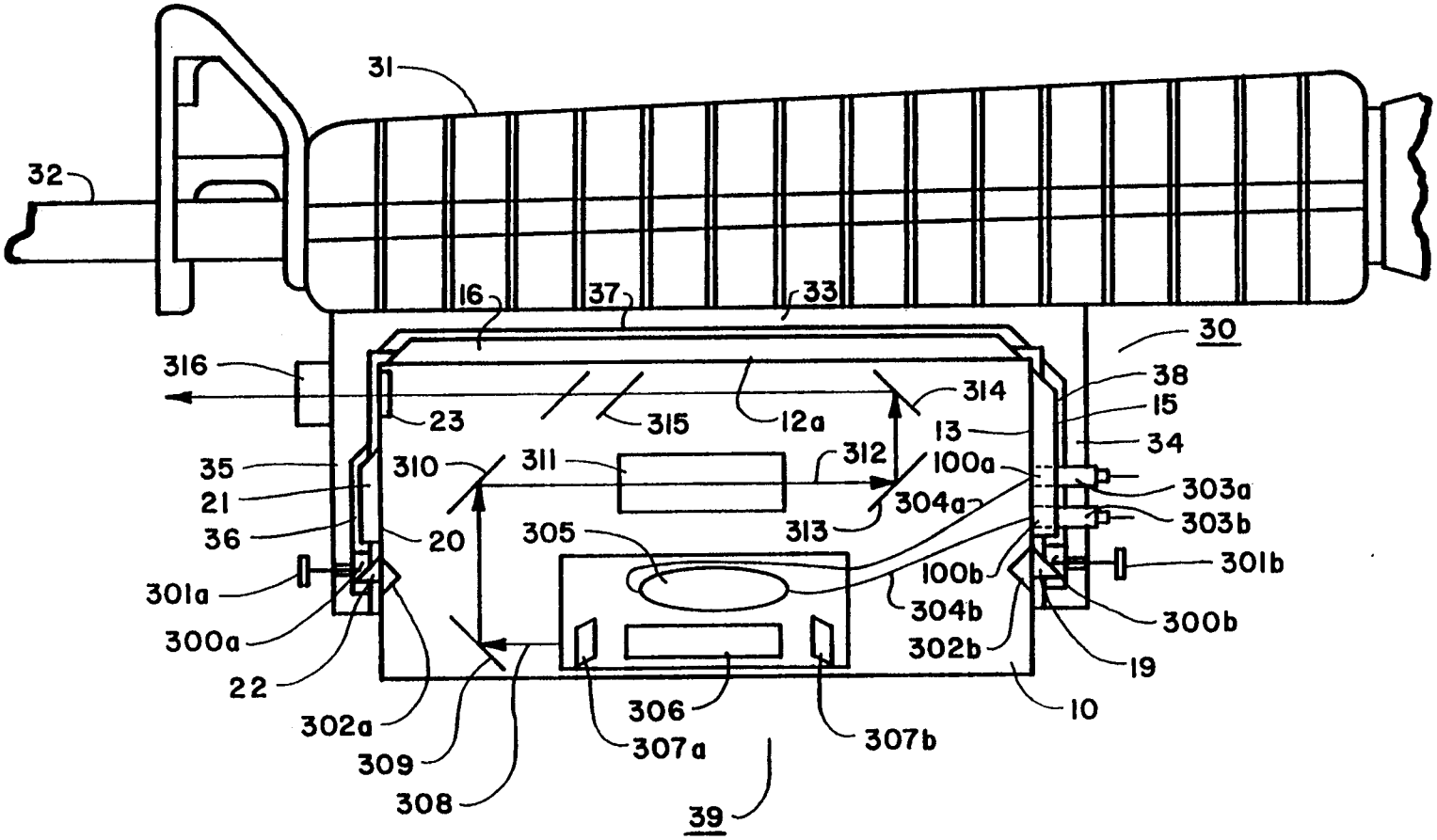
FIG. 3 is a cutaway side view of the present invention on the preferred embodiment.
Figure 4:
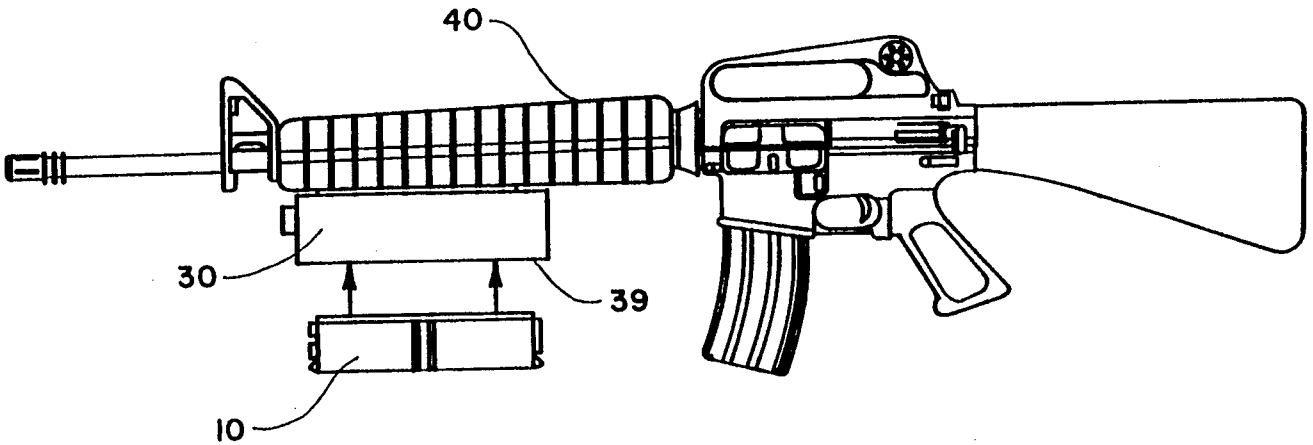
FIG. 4 is a front view drawing of the present invention in the preferred embodiment.

Referring now to the drawings, and more particularly to FIG. 1, there is shown a laser cartridge 10 which includes two identical parallel side walls with one shown as sidewall 11 in FIG. 1, a top wall 12, and a back wall 13. V-way elements such as 14*a* on side wall 11, and 14*b* shown extending outward from the hidden sidewall on other side of laser cartridge 10, allows for fixed alignment within a cartridge receptacle as shown in FIG. 4. Similar V-way elements are included shown as V-way element 15 on back wall 13, element 21 on front wall 20 of FIG. 2, and element 16 on top wall 12 of FIG. 1. Each V-way element shown includes two v-shaped slanted sides so as to allow for easier mating to respective slots shown in FIG. 3. Each of the V-way elements allow for fixed spacial alignment in all 3 dimensions so that optical alignment is achieved. Spring loaded locks 19 of FIG. 1 and lock 22 of FIG. 2 projects outward from side and front walls respectively. Both spring loaded locks allow cartridge 10 of FIG. 1 to be held locked in place as shown in FIG. 3. With cartridge 10 aligned and locked in place, the operation would allow a laser beam to project through optical aperture 23 of FIG. 2 with spring loaded electrical interfaces 100*a* and 100*b* to allow for electrical connection between inside and outside of laser cartridge 10.

FIG. 3 is a cutaway side view of the present invention coupled to a weapon which in the preferred embodiment is a M-16 rifle. Cartridge receptacle 30 is coupled under heat shroud 31 which covers gun barrel 32 of the M-16 rifle. Cartridge receptacle 30 includes a top wall 33, back wall 34, and front wall 35 which along with two sidewalls enclose laser cartridge 10 when locked in place. Laser cartridge 10 is shown fixed in place by V-way elements 21, 16, and 15 into corresponding mated V-way slots 36, 37, and 38 of cartridge receptacle 30. Cartridge receptacle 30 includes an open bottom 39 through which laser cartridge 10 is inserted so as to lock into place with spring loaded locks 19 and 22 into lock openings 300*a* and 300*b*. Lock release pins 301*a* and 301*b* allow spring loaded locks 19 and 22 to be depressed into lock depressions 302*a* and 302*b* to release cartridge 10 from cartridge receptacle 30 when replacement or change is required. Second optical aperture 316 is shown located on front wall 35 which provides for the laser beam generated within cartridge 10 to project therethrough. This locked and aligned arrangement shown in FIG. 3 allows for the laser to function as described next.

Electrical connection is made when laser cartridge 10 is locked in place whereby spring loaded electrical interfaces 100*a* and 100*b* releasably connect to electrical terminals 303*a* and 303*b* located through side wall 34 proximate to interface 100*a* and 100*b*. Power supply leads 304*a* and 304*b* connect to flash lamp 305 such that when power is supplied there is an activation of laser rod 306. Reflective mirrors 307*a* and 307*b* reflect laser light 308 which is diverted by mirror 309 and corner cube 310 through Raman cell 311. Laser light 312 which exits Raman cell 311 is diverted by mirror 313 and 314 and through alignment wedge 315 and finally out optical aperture 23 and out of aperture 316 with both shown in optical alignment when cartridge 10 in releasable locked position as shown in FIG. 3. It is understood that the specific laser rod utilized will be dependent on the specific use contemplated and will provide lasing at different frequencies in the frequency spectrum. Laser rods which may be utilized include: ND:GSGG, ND:YAG, ER:GLASS and TI:Sapphire. Also, other non-linear optical conversion elements can be utilized. It is understood that the invention is not limited to a specific laser. It is understood that the invention is limited to the specific laser system shown in FIG. 3, such as laser rod 306 diode pumped as an alternative to activation by flash lamp 305, by but is the preferred embodiment only.

FIG. 4 shows the preferred embodiment where cartridge receptacle 30 is located coupled underneath the front end of rifle 40. The preferred embodiment is an M-16 rifle where laser cartridge 10 is inserted upward into open bottom 39. It is understood that any weapon may be used to couple with cartridge receptacle 30. Laser cartridge 10 may also be color coded for identification of the laser frequency that the cartridge can generate. This allows the user to quickly determine which specific laser to insert from different cartridges available. It is also understood that the particular materials used for the cartridge walls and other parts would depend on the specific environment to which the cartridge is to be utilized.

While this invention has been described in terms of the preferred embodiment consisting of a interchangeable laser cavity cartridge for an M-16 rifle, those skilled in the art will recognize that the invention can be practiced with modification within the spirit and scope of the appended claims.

I claim:

1. A laser cartridge assembly adapted for interchanging a plurality of laser cavity cartridges, each operational at a different lazing frequency, the assembly comprising:

a receptacle including interconnected top, front, back, and parallel enclosure surfaces, defining a laser cartridge enclosure, the receptacle coupled substantially underneath a weapon for releasable holding a laser cavity cartridge within the cartridge receptacle enclosure, the receptacle further including an aperture through one surface of said cartridge receptacle for projecting a laser beam therethrough, and an electrical contact means on one of an inside receptacle enclosure surface;

slot means in each of said cartridge receptacle surfaces for respectively mating with cartridge alignment means;

a cartridge of the plurality of laser cavity cartridges with interconnecting top, bottom, front, back, and parallel surfaces, with inner surfaces thereof defining a laser cavity within the cartridge, the cartridge further including an aperture within one surface of said interconnecting surfaces thereof which allows projection of a laser beam therethrough when properly aligned with the aperture of the laser cartridge receptacle, with said laser cavity containing a lazing means designed to operate at a specific lazing frequency, further including electrical contact means which project through and outward of said cartridge for mating with the electrical contact means in the laser receptacle;

an alignment means on outside said top, front, back, and parallel surfaces of said cartridge, corresponding to a respective slot means for releasable coupling to the slot means, whereby when the cartridge is releasable held within the cartridge receptacle, optical alignment is achieved between the respective apertures such that activation of the laser cavity through electrical connection between the respective electrical contact means allow projection of the laser beam through the cartridge and the cartridge receptacle to a target.

2. A method of interchanging various interchangeable laser cavity cartridges designed to operate at different lazing frequencies, releasably locked within a receptacle coupled to a weapon comprising:

providing a receptacle coupled substantially underneath a weapon for releasably holding one of the various interchangeable laser cavity cartridges substantially enclosed therwithin, with an aperture projecting through a receptacle enclosure surface;

providing one of various interchangeable cartridge housings for the various interchangeable laser cavity cartridges, each of the housings defining a laser cavity including lazing means capable of operating at a separate lazing frequency, with an aperture projecting through the cartridge housing;

inserting said interchangeable laser cavity cartridge into said receptacle such that the cartridge is optically aligned and releasable locked within the receptacle with both of the apertures optically aligned, and electrical connection is made from the receptacle therethrough the cartridge housing;

activating the lazing means such that a laser beam projects through the cartridge and receptacle to a target, and whereby upon deactivation of the lazing means, the cartridge can be released from the receptacle and another one of said interchangeable laser cavity cartridges with a laser cavity containing a different lazing means designed to operate at a different lazing frequency may be releasable locked within the receptacle for activation and emission of a different laser beam.

* * * * *